US006726347B2

(12) United States Patent
Wronski

(10) Patent No.: US 6,726,347 B2
(45) Date of Patent: Apr. 27, 2004

(54) RECESSED LIGHTING

(75) Inventor: Grzegorz Wronski, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/135,951

(22) Filed: Apr. 30, 2002

(65) Prior Publication Data

US 2003/0137846 A1 Jul. 24, 2003

Related U.S. Application Data

(60) Provisional application No. 60/349,362, filed on Jan. 22, 2002.

(51) Int. Cl.[7] ..... F21V 17/00

(52) U.S. Cl. ..... 362/364; 362/365; 362/444; 362/396

(58) Field of Search ..... 362/226, 364, 362/365, 444, 396

(56) References Cited

U.S. PATENT DOCUMENTS

| | | | | |
|---|---|---|---|---|
| 3,099,404 A | | 7/1963 | Kaufman et al. | |
| 3,313,931 A | | 4/1967 | Klugman | |
| 4,293,895 A | * | 10/1981 | Kristofek | 362/147 |
| 5,222,800 A | | 6/1993 | Chan et al. | |
| 5,662,413 A | | 9/1997 | Akiyama | |
| 5,673,997 A | | 10/1997 | Akiyama | |
| 5,707,143 A | | 1/1998 | Hentz | |
| 5,826,970 A | | 10/1998 | Keller et al. | |
| 5,857,766 A | | 1/1999 | Sieczkowski | |
| 6,004,011 A | | 12/1999 | Sieczkowski | |
| 6,116,750 A | | 9/2000 | Hentz | |
| 6,123,438 A | | 9/2000 | Hentz | |
| 6,168,299 B1 | | 1/2001 | Yan | |
| 6,364,511 B1 | * | 4/2002 | Cohen | 362/368 |

* cited by examiner

*Primary Examiner*—Sandra O'Shea
*Assistant Examiner*—Guiyoung Lee
(74) *Attorney, Agent, or Firm*—Thomas, Kayden, Horstemeyer & Risley LLP

(57) ABSTRACT

A recessed light fixture includes a light source enclosure face defining an aperture. The enclosure face includes a spring retainer spaced outward from the aperture. The spring retainer includes a bridge portion forming a portion of the circumference of the aperture and a slot defined between the bridge portion and the enclosure face.

31 Claims, 4 Drawing Sheets

RECESSED LIGHTING

This application claims the benefit of U.S. Provisional Application Ser. No. 60/349,362, filed Jan. 22, 2002, incorporated herein by reference.

BACKGROUND

This invention relates to recessed lighting.

Light fixtures that are recessed in thermal barriers in buildings may form conducting thermal conduits across the barriers. For example, a light fixture recessed in a ceiling separating a heated room from an unheated attic may penetrate into insulation above the ceiling and form a low resistance path for the flow of heated air from the room to the attic, decreasing the energy efficiency of the house and increasing the monthly energy bill of the homeowner.

SUMMARY

To limit the flow of air across a thermal barrier, a recessed light fixture may include a light source enclosure face defining an aperture. The enclosure face may include a spring retainer spaced outward from the aperture. The spring retainer may include a bridge portion forming a portion of the circumference of the aperture and a slot defined between the bridge portion and the enclosure face.

Implementations may include one or more of the following features. For example, the enclosure face may be a reflector face. The aperture may be dimensioned to pass a connection portion of alight source. The slot may be oriented substantially transversely relative to the aperture. The bridge portion may be substantially coplanar with the enclosure face. The bridge portion may be inside the light source enclosure bounded by the enclosure face, for example, the bridge portion may be less than about ⅛ of an inch inside. The bridge portion may be joined to the enclosure face by a pair of joining portions at the ends of the bridge portion.

The recessed light fixture may also include a socket configured to connect to a light source. The socket may be mounted in alignment with the aperture. The recessed light fixture may also include a spring received in the slot to mount the socket in alignment with the aperture. The aperture may be substantially circular and the spring retainer may be spaced radially outward from the aperture.

The light source enclosure face may also include a second spring retainer including a second bridge portion forming a second portion of the circumference of the aperture and a second slot defined between the second bridge portion and the enclosure face. The spring may include a pair of legs, with each leg joined to the socket and having a curved latching end. The spring retainers may be diametrically opposed about the aperture.

In another general aspect, a recessed light fixture includes a light source enclosure face defining an aperture and a slot spaced outward from the aperture. The slot may be oriented substantially transversely relative to the aperture.

Implementations may include one or more of the following features and one or more of the features noted above. For example, the light source enclosure face may define a second slot spaced radially outward from the aperture. The second slot may be oriented substantially transversely relative to the aperture. The slots may be diametrically opposed about the aperture. The aperture may be substantially circular, and the slot may be spaced radially outward from the aperture.

The details of one or more implementations are set forth in the accompanying drawings and the description below.

Other features, objects, and advantages will be apparent from the description and drawings, and from the claims.

DETAILED DESCRIPTION

Figure 1:
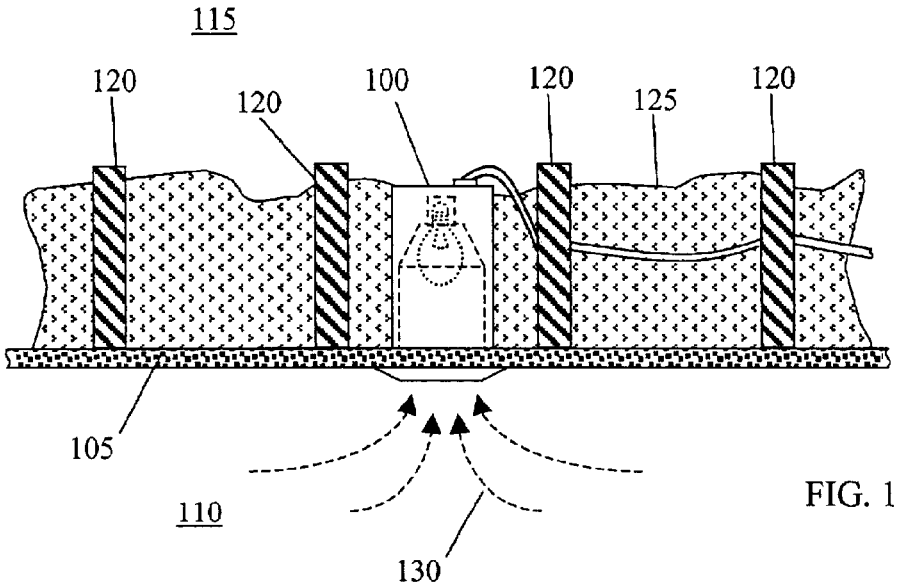
FIG. 1 is schematic view of a recessed light fixture in a ceiling of a building.

Referring to FIG. 1, a recessed light fixture 100 is recessed in a ceiling 105 to illuminate a room 110 in a building. Ceiling 105 is part of a thermal barrier between room 110 and an attic 115. Ceiling 105 is supported by ceiling joists 120 and covered by thermal insulation 125. Light fixture 100 penetrates into the thermal barrier separating room 110 and attic 115, but limits the flow 130 of air between room 110 and attic 115 due to the penetration.

Figure 2:
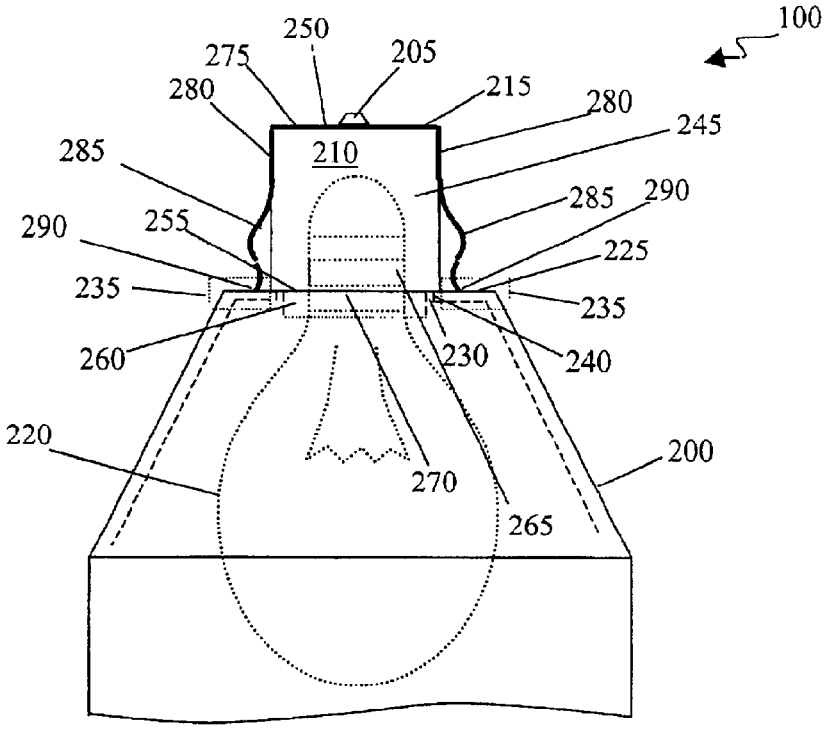
FIG. 2 is a side view of a reflector portion of the recessed light fixture of FIG. 1 with a mounted socket.

Referring to FIG. 2, recessed light fixture 100 includes a reflector chamber 200, a connection rivet 205, a socket 210, and a spring retainer 215. Reflector chamber 200 encloses a bulb 220 and reflects downward light emitted by bulb 220. Connection rivet 205 joins spring retainer 215 to socket 210. Socket 210 is releasably mounted to reflector chamber 200 by spring retainer 215 and forms a mechanical and electrical connection to bulb 220 to retain bulb 220 in position and supply bulb 220 with power.

Reflector chamber 200 has an upper face 225 that defines a substantially circular aperture 230 and includes a pair of spring receivers 235. Aperture 230 is bounded by a circumferential wall 240.

Socket 210 includes a socket body 245 with a top face 250 and an opposing bottom face 255. Bottom face 255 is joined to an annular lip 260. Annular lip 260 is dimensioned to be insertable into aperture 230 so that bottom face 255 of socket 220 abuts reflector upper face 225. Socket body 245 and annular lip 260 together define a female threaded chamber 265 for connecting to a threaded portion 270 of bulb 220.

Spring retainer 215 is generally shaped like an inverted "U" and includes a top flat portion 275 joined to a pair of downwardly extending lateral legs 280. Each of legs 280 includes an arcuate lever portion 285 and an insertable latch portion 290. Each lever portion 285 bends outwardly away from the opposite leg 280 and provides a surface that an operator can manipulate to press legs 280 together. Latch portions 290 are disposed at the end of respective legs 280 and are curved outwardly for mating with spring receivers 235 to mount socket 210 to reflector chamber 200.

Figure 3:
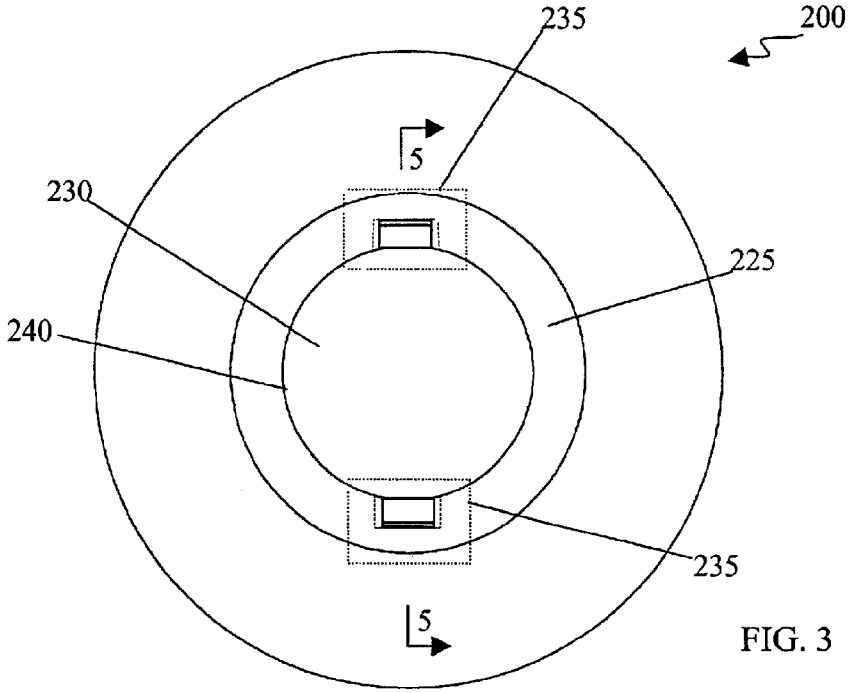
FIG. 3 is a top view of the reflector portion of the recessed light fixture of FIG. 2.

Referring to FIG. 3, which illustrates upper face 225 of reflector chamber 200 without socket 210 or spring retainer 215 being present, spring receivers 235 are disposed on diametrically opposite sides of the circumferential wall 240 of aperture 230 to receive latch portions 290 of a straight spring retainer 215 (not shown).

Figure 4:
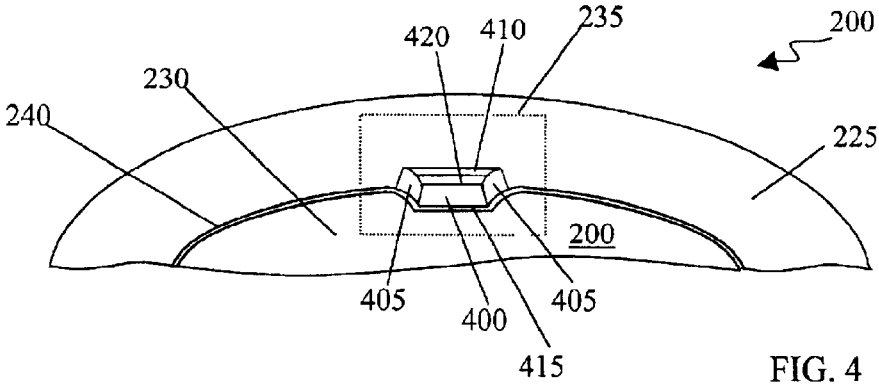
FIG. 4 is a diagrammatic view of the reflector portion of FIG. 2.

Referring also to FIG. 4, each spring receiver 235 includes a stamped bridge portion 400, a pair of joining portions 405 on opposite sides of bridge portion 400, and an upper face wall 410. Bridge portions 400 are substantially coplanar with upper face 225 but depressed into reflector chamber 200 by, for example, stamping. Bridge portions 400 include an inner radial face 415 and an outer face 420. Inner radial face 415 is formed from the circumferential aperture wall 240 when bridge 400 is depressed into reflector chamber 200. Outer face 420 separates from upper face wall 410, for example, during stamping. Joining portions 405 rise from bridge portion 400 to join with reflector face 225 and maintain bridge portions 400 in a fixed position below reflector face 225.

Figure 5:
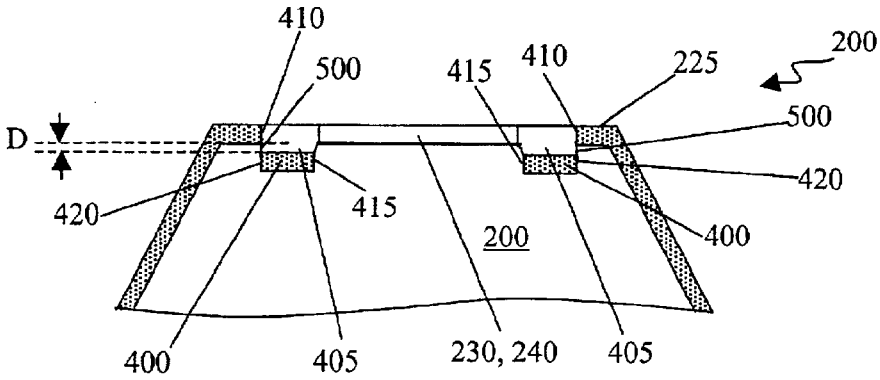
FIG. 5 is a sectional view of the reflector portion of FIG. 2 taken along the section 5—5 of FIG. 3A.

Referring also to FIG. 5, outer radial face 420, joining portions 405, and upper face wall 410 together define a pair of opposing slots 500 disposed radially outward from circumferential aperture wall 240. Slots 500 are dimensioned to receive latch portions 290 of spring retainer 215, and may have a height of D. D may be approximately equal to the thickness of latch portion 290. For example, D may be less than ⅛ of an inch, or D may be about 1/16 of an inch. The relatively small size of slots 500 limits air flow through slots 500 and across a thermal barrier into which light fixture 100 is recessed.

Figure 6:
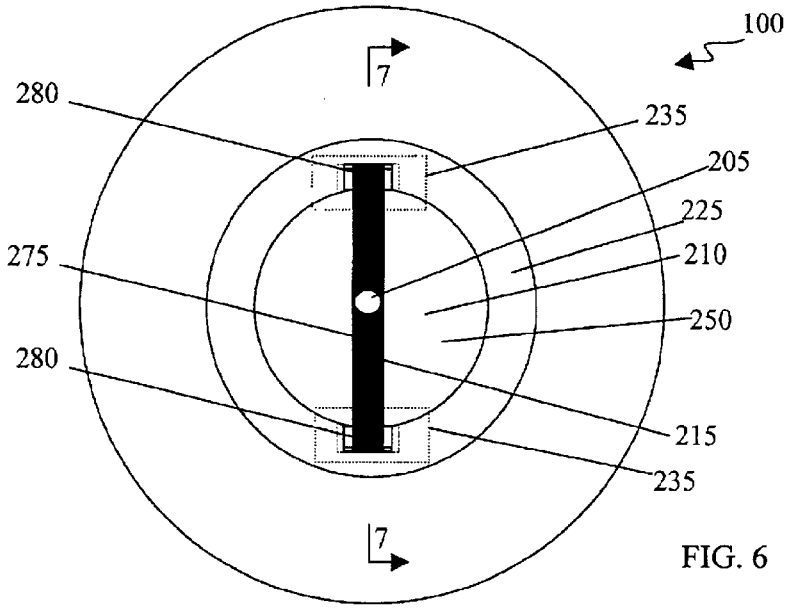
FIG. 6 is a top view of the reflector portion of FIG. 2 with the mounted socket.

Referring to FIG. 6, when light fixture 100 is assembled, top flat portion 275 of spring retainer 215 traverses top face 250 of socket 210 and is joined to top face 250 at rivet 205. Legs 280 are aligned with spring receivers 235.

Figure 7:
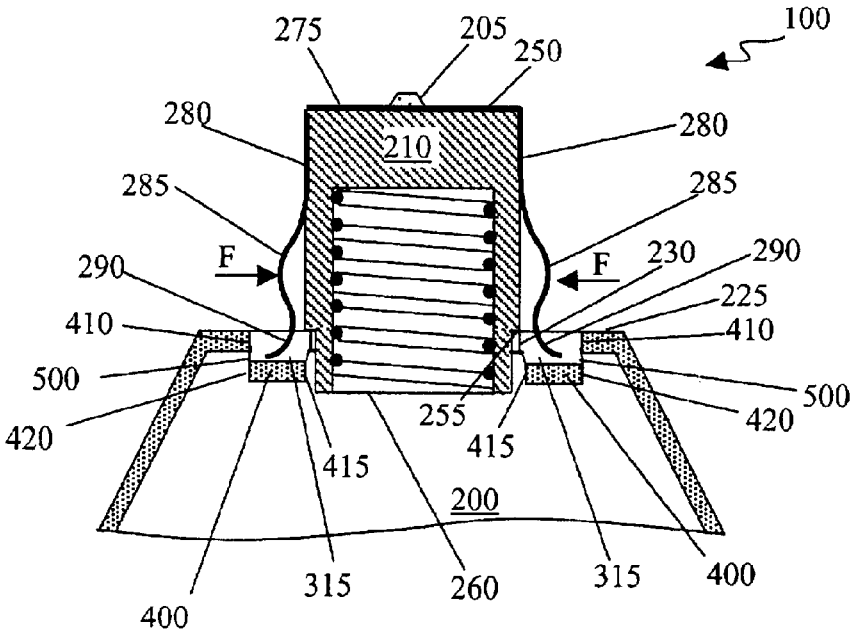
FIG. 7 is a sectional view of the reflector portion of FIG. 2 taken along section 7—7 of FIG. 6 during mounting of the socket.

Referring to FIG. 7, to assemble light fixture 100, an operator first applies a force F to each lever portion 285 to press legs 280 together and inward toward socket 210. The operator then inserts annular lip 260 into aperture 230 such that bottom face 255 of socket 210 abuts upper face 225 of reflector chamber 200. Socket 210 is rotated so that latch portions 290 are aligned with slots 500.

Figure 8:
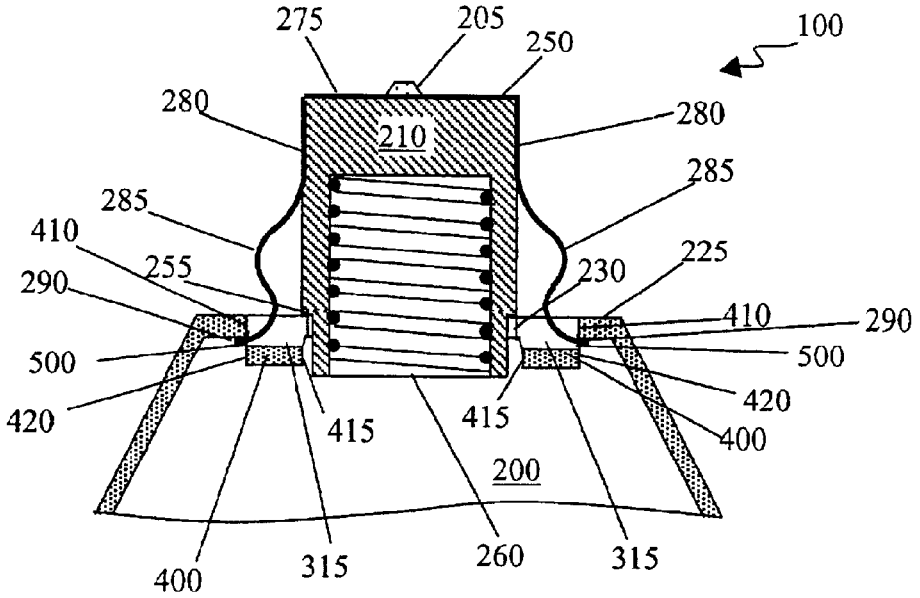
FIG. 8 is a sectional view of the reflector portion of FIG. 2 taken along section 7—7 of FIG. 6 after mounting of the socket.

Referring to FIG. 8, the operator then releases lever portions 285, which permits spring retainer legs 280 to expand to slide latch portions 290 into slots 500 and retain socket 210 at upper surface 225. Sliding latch portions 290 into slots 500 fills at least a portion of slots 500 and limits air flow across a thermal barrier into which light fixture 100 is recessed.

When assembled, annular lip 260 extends past inner radial faces 415 of the bridges 400 to loosely seal aperture 230 and minimize the flow of air between socket 210 and reflector chamber 200. This too limits air flow across a thermal barrier into which light fixture 100 is recessed.

A number of implementations have been described. Nevertheless, it will be understood that various modifications may be made. For example, the shape of spring retainer 215 may be changed. Accordingly, other implementations are within the scope of the following claims.

What is claimed is:

1. A recessed light fixture comprising:

a light source enclosure face defining an aperture and including a spring retainer spaced outward from the aperture, the spring retainer including a bridge portion displaced perpendicularly from the enclosure face and forming a portion of the circumference of the aperture and a slot defined between the bridge portion and the enclosure face, wherein the bridge portion is substantially flat and substantially coplanar with the enclosure face.

2. The recessed light fixture of claim 1 wherein the enclosure face is a reflector face.

3. The recessed light fixture of claim 1 wherein the aperture is dimensioned to pass a connection portion of a light source.

4. The recessed light fixture of claim 1 wherein the slot is oriented substantially perpendicular relative to the enclosure face.

5. The recessed light fixture of claim 1 wherein the bridge portion is inside the light source enclosure bounded by the enclosure face.

6. The recessed light fixture of claim 5 wherein the bridge portion is less than about ⅛ of an inch from the light source enclosure face.

7. The recessed light fixture of claim 5 wherein the bridge portion is joined to the enclosure face by a pair of joining portions at the ends of the bridge portion.

8. The recessed light fixture of claim 1 further comprising a socket mounted in alignment with the aperture, the socket being configured to connect to a light source.

9. The recessed light fixture of claim 8 further comprising a spring received in the slot to mount the socket in alignment with the aperture.

10. The recessed light fixture of claim 9 wherein:

the light source enclosure face further comprises a second spring retainer including a second bridge portion forming a second portion of the circumference of the aperture and a second slot defined between the second bridge portion and the enclosure face; and the spring comprises a pair of legs, with each leg joined to the socket and having a curved latching end.

11. The recessed light fixture of claim 1 wherein the light source enclosure face further comprises a second spring retainer including a second bridge portion forming a second portion of the circumference of the aperture and a second slot defined between the second bridge portion and the enclosure face.

12. The recessed light fixture of claim 11 wherein the spring retainer and the second spring retainer are diametrically opposed about the aperture.

13. The recessed light fixture of claim 1 wherein:

the aperture is substantially circular; and the spring retainer is spaced radially outward from the aperture.

14. A recessed light fixture comprising a substantially planar light source enclosure face defining an aperture and a slot spaced outward from the aperture, the slot being oriented substantially perpendicular relative to the enclosure face, and a bridge portion defining an edge of the slot, the bridge portion being substantially coplanar with the enclosure face.

15. The recessed light fixture of claim 14 wherein the aperture is dimensioned to pass a connection portion of a light source.

16. The recessed light fixture of claim 14 wherein the bridge portion is inside the light source enclosure bounded by the enclosure face.

17. The recessed light fixture of claim 14 wherein the bridge portion is less than ⅛ of an inch from the light source enclosure face.

18. The recessed light fixture of claim 14 wherein the bridge portion is joined to the enclosure face by a pair of joining portions at the ends of the bridge portion.

19. The recessed light fixture of claim 14 further comprising a socket mounted in alignment with the aperture, the socket configured to connect to a light source.

20. The recessed light fixture of claim 19 further comprising a spring received in the slot to mount the socket in alignment with the aperture.

21. The recessed light fixture of claim 20 wherein:

the light source enclosure face defines a second slot spaced radially outward from the aperture; and the spring comprises a pair of legs each joined to the socket and having a curved latching end.

22. The recessed light fixture of claim 14 wherein the light source enclosure face defines a second slot spaced radially outward from the aperture, the second slot being oriented substantially perpendicular relative to the enclosure face.

23. The recessed light fixture of claim 22 wherein the slot and the second slot are diametrically opposed about the aperture.

24. The recessed light fixture of claim 14 wherein:

the aperture is substantially circular; and the slot is spaced radially outward from the aperture.

25. A house comprising a recessed light fixture including a light source enclosure face defining an aperture and a spring retainer spaced outward from the aperture, the spring retainer including a bridge portion displaced perpendicularly from the enclosure face and forming a portion of the circumference of the aperture and a slot defined between the bridge portion and the enclosure face wherein the bridge portion is substantially flat and substantially coplanar with the enclosure face.

26. The house of claim 25 wherein:

the light source enclosure face further comprises a second spring retainer including a second bridge portion forming a second portion of the circumference of the aperture and a second slot defined between the second bridge portion and the enclosure face, the pair of spring retainers are diametrically opposed about the aperture.

27. A recessed light fixture, comprising:

a lamp housing;

a socket, disposed within th lamp housing;

a socket spring, connected to the socket, including a leg and a latching end for positioning the socket relative to the lamp housing;

a reflector trim, disposed substantially within the lamp housing, defining a light source enclosure face, an aperture and a spring retainer comprising a bridge portion for receiving the latching end along an insertion axis that is perpendicular to a longitudinal axis of the socket, wherein the bridge portion is substantially flat and substantially coplanar with the light source enclosure face.

28. The light fixture of claim 27, wherein the latching end is perpendicular to the longitudinal axis of the socket.

29. The light fixture of claim 27 further comprising:

a second leg and a second latching end for positioning the socket relative to the socket relative to the lamp housing; and a second spring retainer defined by the light source enclosure face for receiving the second latching end along the insertion axis.

30. The light fixture of claim 27, wherein the bridge portion is displaced from the reflector face for forming a slot, the slot receiving the latching end along the insertion axis.

31. The light fixture of claim 30, wherein the bridge portion is disposed in a plane that is parallel to the reflector face.

* * * * *